United States Patent [19]

Atzrott et al.

[11] 3,934,069

[45] Jan. 20, 1976

[54] NON-SMUDGING PRESSURE-SENSITIVE COPYING MATERIAL

[75] Inventors: Otto Atzrott, Ludwigshafen; Wolfgang Sliwka, Weinheim; Heinz Hartmann, Mannheim, all of Germany

[73] Assignee: BASF Aktiengesellschaft, Ludwigshafen (Rhine), Germany

[22] Filed: June 28, 1974

[21] Appl. No.: 484,081

[30] Foreign Application Priority Data

July 5, 1973 Germany ..... 2334227

[52] U.S. Cl. ..... 428/323; 252/316; 427/144

[51] Int. Cl.[2] ..... B41M 5/00; B41M 5/02

[58] Field of Search ..... 117/36.8, 36.7, 36.2; 252/316; 282/28 R; 428/323, 307; 427/144

[56] References Cited

UNITED STATES PATENTS

| | | | |
|---|---|---|---|
| 2,348,128 | 5/1944 | Groak | 282/28 R |
| 2,927,041 | 3/1960 | Davis | 117/36.2 |
| 3,418,250 | 12/1968 | Vassiliades | 252/316 |
| 3,689,302 | 9/1972 | Kubo et al. | 117/36.8 |
| 3,843,383 | 10/1974 | Ishige et al | 117/36.8 |

*Primary Examiner*—Thomas J. Herbert, Jr.
*Attorney, Agent, or Firm*—Johnston, Keil, Thompson & Shurtleff

[57] ABSTRACT

A pressure-sensitive copying material consisting of a sheet-like base to which has been applied a coating comprising microcapsules containing dyes. The microcapsules are filled with a solution or suspension of a salt of a dye base and an organic carboxylic acid in an organic water-immiscible solvent. The copying material is distinguished by exceptional non-smudging characteristics and is particularly suitable for the production of business forms.

11 Claims, No Drawings

NON-SMUDGING PRESSURE-SENSITIVE COPYING MATERIAL

The invention relates to a pressure-sensitive copying material consisting of a sheet-like base to which has been applied a coating comprising microcapsules containing dye salts.

Amongst color-transfer copying papers, those using carbon as the colorant are used most. These papers suffer from a number of disadvantages. The interposition of a copying paper produces a thick stack of paper if several copies are required, and limits the number of legible copies. This disadvantage can be circumvented if the coloring coating is applied directly to the back of the original. However, what cannot be circumvented is the low rub resistance and smudge resistance of the coloring coating. When handling the copying papers, color gets onto the fingers, which then soil the originals and copies. If the papers slide in the stack, they soil the copies. The copy is not rub-resistant. Copying papers which have been used several times show previous script on the white papers, because the wax covering layer has been destroyed, and in the case of carbonless papers the original is liable to print in a given stack. Thus, the production of clean originals and non-smudging copies is difficult or impossible.

In contrast, color exposure papers are clean to handle. They bear a continuous coating which in most cases is black, and which is covered with an opaque white outer coating. This white outer coating is rendered transparent by mechanical pressure, for example by being struck with the typewriter keys, and the black layer underneath it becomes visible. The principal disadvantage of these papers is that the copies can be altered at any time and slight pressure exerted by more or less pointed objects exposes the black coating underneath, so that these papers present an untidy appearance. Furthermore there are limitations regarding their printability, for example for business forms.

Reactive copying material circumvents the shortcomings of the above papers. They have a capsule coating applied to the back. The capsules contain a colorless solution of a dye intermediate in, for example, an organic liquid. The sheet underneath the original contains a coating comprising a reagent, on its upper face. If the capsules are ruptured by the pressure of a pencil or by being struck with a typewriter key, their contents exude onto the sheet below where they are developed to a dye by means of the reagent (for example an acid clay) for the dye intermediate contained in the solution. This produces a copy. Such papers require a coating which contains the capsules and provides the dye intermediate, and a developing coating. Whilst having the advantage of being clean to handle and giving a copy which can no longer react by itself, such papers present the manufacturer with some difficulties. The acceptor coating on the upper face of the copy is difficult to print since the coating carrying the reagent cannot be filled to be sufficiently picking-resistant. The coating containing the reagent modifies the surface properties of the papers. Thus, papers conforming to a standard specification for certain purposes cannot be produced with an acceptor coating. Thus, reactive copying papers cannot be employed, for example, in optical document scanning.

Another disadvantage resides in the available dye intermediates. The dye intermediates hitherto employed, such as crystal violet lactone and N-benzoyl-leuco-methylene blue, give a copy which is difficult or impossible to copy with copying equipment, for example Xerox equipment, since it has a low absorption in the blue wave-length range. Black copies which can readily be copied can be produced by a combination of, for example, a blue, yellow and red dye intermediate. Naturally, the dye intermediates differ in speed of color development, intensity and fastness to light. Papers produced therewith give different black or gray shades on different acceptor faces and gradually discolor on storage. In general terms, the fastness to light of dyes produced from such dye intermediates is less than that of copying papers containing carbon.

It is an object of the present invention to provide a nonsmudging copying material which does not soil the hands of persons handling it. The upper face of the copies should show as little soiling as possible. The material should permit the production of the copy on any conventional base, mainly paper, without a special acceptor face. The material should give copies which are as lightfast as possible and should above all give black as well as colored copies, and give copies which can be copied on conventional equipment. The copies should be non-smudging. A black copy should, if possible, be obtainable by using only a single dye.

We have found a non-smudging, pressure-sensitive copying material of a sheet-like base and a coating comprising microcapsules containing a dye, with or without binders, fillers and pigments, wherein the microcapsules are filled with a solution or suspension of a salt of a dye base and an organic carboxylic acid in an organic water-immiscible solvent.

Dye bases which can be used are the basic dyes commercially available under the description of dye bases or color bases, for example the oxidation products of aniline, such as nigrosine bases and induline bases, Victoria Blue base, Methyl Violet base, rhodamine base, auramine base and chrysoidine base. Nigrosine bases LT and C (C.I. Solvent Black 7) and induline bases N and NR (C.I. Solvent Blue 7) are particularly preferred. Preferred organic acids are aliphatic carboxylic acids with eight to 30 carbon atoms.

The salts of such dye bases have already been employed for copying papers containing carbon. When used in the conventional combination with oleic acid, fats and ester waxes, papers produced therewith show penetration of oil and dye salt. Hence, they are only added in small amounts.

The concentrated dye bases have a high viscosity, which is as a rule lowered by dilution with oleic acid or alcohol and/or glycol ethers. Because of their high polarity and in part because of their acid character, these solvents cannot, however, be encapsulated by means of the conventional encapsulation processes and using the conventional wall materials. On the other hand, the high viscosity of the concentrated pastes prevents transfer of the pastes from the capsules onto the paper face opposite thereto, for the purpose of producing the copies.

The encapsulation of high concentrations of soluble dyes in aqueous dispersion presents difficulties. Basic or acid dyes in the main only give solutions of high concentrations in water, alcohols and glycols. The problem of tightly encapsulating these systems for a prolonged period, without loss of solvent, has hitherto not been solved satisfactorily.

It is surprising to find that the dye salts alone, even without added pigments, give, when used at high concentration, intense and easily legible copies if water-immiscible solvents or solvent mixtures — also described as core solvents — are used for dilution. These solvents or diluents lower the viscosity of the dye salt solution very greatly and can be encapsulated by conventional encapsulation processes. If the ratio of such solvents, which can be classified as "more efficient" and "less efficient" solvents, is selected correctly, copies without edges of a different color are produced, that is to say no bleeding occurs.

The procedure followed is, for example, to dissolve the dye bases by means of the organic carboxylic acids, for example myristic, behenic, tetradecanoic, oleic, linoleic, stearic, palmitic, lauric or abietic acid, in accordance with conventional processes. Particularly good results are achieved if the ratio of acid to dye base is equal to or only slightly greater than the stoichiometric ratio. Suitably, the molar ratio of organic carboxylic acid to dye base is from about 1:1 to 2:1. The large excess of acid conventionally used in practice for dissolving the dye bases give solutions which are difficult to encapsulate.

For encapsulation, the dissolved dye bases can be adjusted to the desired concentration by dilution with the water-immiscible organic solvent. Alternatively, however, the solvent can be added during the dissolution step so as to give lower viscosities immediately. Water-immiscible solvents which have proved suitable for this purpose are solvents which are liquid and have a low volatility at room temperature, such as — amongst "less efficient" solvents — aliphatic hydrocarbons, such as high-boiling gasolines, kerosene and spindle oil, araliphatic hydrocarbons, such as alkylbenzenes with alkyl groups of two to twenty carbon atoms, such as isopropylbenzene, n-dodecylbenzene and triethylbenzene, methylphenylindene, alkylnapthalene, diphenyls and terphenyls and — amongst "more efficient" solvents — phthalic acid esters of higher alcohols ($C_3$ to $C_{18}$), such as dibutyl phthalate, dihexyl phthalate, diethylhexyl phthalate, dicetyl phthalate and diisobutyl phthalate, and mixtures of these solvents.

The concentration of the dye base in the solvent is suitably 5 to 50, and preferably 10 to 35 per cent by weight. The weight ratio of the organic carboxylic acid, used to dissolve the dye base, to the solvent is then conveniently from about 1:1 to 1:10. The viscosity of the solution or suspension is suitably 10 to 10,000, preferably 50 to 3,000, cP measured at a shear rate of 100 $sec^{-1}$.

The solutions or suspensions obtained can be encapsulated by conventional processes. However, it is to be borne in mind that the normal products of dissolution of the bases with excess acids, for example oleic acid, with or without added fats and ester resins, cannot be encapsulated, or cannot be encapsulated tightly, since the known wall materials, such as gelatine and acrylic ester copolymers, are partially dissolved by these materials, or interfere with the encapsulation. This causes agglomeration of the encapsulation batches.

Examples of suitable encapsulation processes are those described in Austrian Pat. No. 199,206 and German published specification No. 2,119,933. The same procedures as are described in these specifications can be used for adjusting the particle size and concentration of the capsules in the dispersion in water. The diameter of the capsules will in general be 1 to 40 $\mu$.

The capsules can contain colored pigments, such as carbon black or phthalocyanines, in addition to the solutions containing the dye salt.

The non-smudging pressure-sensitive copying material is manufactured by conventional methods, for example by coating sheet material consisting of paper, textiles, polymers or metals (for example aluminum foils) by means of rollers, air brushes or doctor knives, for example on a paper-coating machine. The amount applied, expressed as capsules, is suitably from 3 to 10 g/m². The capsule dispersion is formulated, for coating, in accordance with the intended use. It can be of advantage to add to the dispersion a natural or synthetic binder, for example casein, starch or, preferably, a polymer dispersion based on vinyl acetate, styrene/-butadiene, styrene/acrylate and acrylate copolymers, and so-called spacer fillers in the form of ground cellulose or polystyrene, advantageously of spherical shape, or customary types and amounts of other fillers or pigments. In order to mask the inherent color of the capsules, the capsule coating can be provided, by conventional methods, with a masking, foamed or pigmented, surface coating with which the paper can be treated even before applying the capsule coating, in order to reduce the show-through of the tint in the case of light-weight papers. It is also possible to add the capsules to the paper and incorporate them therein by this method.

The coating gives the coated surface of the copying material a pleasant, dry, papery hand. Even vigorous rubbing with the fingers does not break the capsules open so that the hands do not become soiled. It is possible to use the product without interleaving and/or an acceptor face, which would always require a separate coating or treatment. The paper will produce a copy 3 to 4 times if it is employed purely as a copying paper. It is a particular advantage that the copy can be produced on any conventional paper surface, without the latter having to be matched to the copying system. It is possible to produce not only various colors, but also, above all, neutral black copies with a single dye which does not contain carbon. The shade of black is stable, can be copied readily, and has good fastness to light. The amount of microcapsules required, 4 to 5 g/m² being applied, is slightly less than in the case of one-time carbon papers which use 5 to 7 g/m², or copying papers which use 12 to 14 g/m². It is a further important advantage of the papers that in contrast to the case of carbon papers, the copy is non-smudging after a very short time (which depends on the type of paper). The solvent carries the dye into the paper and fixes it therein, whilst with carbon papers the (solid) dye is transferred onto the surface of the paper and smudges readily. The fact that the capsule coating exhibits the color of the contents of the capsules can be modified or eliminated by suitable masking coatings without significant detriment ot the copying capacity.

The copying material according to the invention, especially when paper is used as the base, is outstandingly suitable for the production of business forms, such as are employed increasingly for orders, applications, sales contracts, bookings and electronic data processing installations, above all with optical document scanning.

Some embodiments of the non-smudging pressure-sensitive copying paper claimed, and their manufacture, are described in the Examples which follow.

Unless otherwise stated, the parts and percentages mentioned are by weight. Parts by volume bear the same relation to parts by weight as the liter to the kilogram.

EXAMPLE 1

A. Preparation of the dye salt solution (dissolution of the base)

200 parts of oleic acid are introduced into a glass flask of capacity 2,000 parts by volume, which is fitted with a powerful anchor stirrer, and are stirred therein. 250 parts of commercial nigrosine base LT are then poured in slowly. The mixture is heated on a water bath until a homogeneous solution results; this requires from 1 to 2 hours. The solution which is mobile when warm is treated with 300 parts of spindle oil and 400 parts of diethylhexyl phthalate. The viscosity of the solution after cooling to room temperature is 900 cP. Concentration of dye base in the solution is 21.8 percent by weight.

B. Dispersing and encapsulating the dye salt solution

A solution of 800 parts of water and 120 parts of a 10% strength polyvinylpyrrolidone solution (K value 90) is introduced, at room temperature, into a glass vessel of capacity 5,000 parts by volume, into which dips an Ultra-Turrax T 45 (manufactured by Jahnke and Kunkel, Oberstaufen, Federal Republic of Germany) running at 9,000 r.p.m.; 96 parts of isopropanol and 272 parts of the dye salt solution prepared under (A) are dispersed therein. An emulsion of the dye salt solution in water, with droplet diameters from 1 to 30 $\mu$, is produced instantly.

A solution of a wall material, consisting of a copolymer (relative viscosity 1.59, measured as a 1% strength solution in chloroform) of 160 parts of acrylamide, 420 parts of methyl methacrylate and 1 part of vinylsulfonic acid in 1,000 parts of isopropanol and 500 parts of chloroform, is then run into the emulsion over 10 minutes by running it directly into the gap of the Turrax generator. The Turrax is then run for a further 0.5 minute and is thereafter switched off; the particle size is determined and the mean particle diameter is found to be from 8 to 12 $\mu$.

C. Distillation and curing 1,000 parts of the capsule dispersion thus obtained are introduced into a glass flask of capacity 2,000 parts by volume, equipped with a stirrer (120 rpm) and a descending condenser, into which flask 420 parts of water at 40°C had been introduced beforehand. The contents of the flask are heated and the chloroform and isopropanol are distilled off in the course of 1.5 hours, starting at 65°C. During the process the temperature rises to 84°C. 15 parts of 40% strength formaldehyde solution are then added and the dispersion is kept at 80°C for a further 0.5 hour, during which the wall material crosslinks. The dispersion is then cooled. The moist residue retained on a sieve amounts to 20 parts and consists in the main of capsule agglomerates.

To avoid the dispersion separating out on standing, 17.5 parts of a 25% strength dispersion of an emulsion copolymer of 56 parts of ethyl acrylate, 34 parts of methacrylic acid, 10 parts of acrylic acid, 0.1 part of vinylsulfonate and 0.25 part of dialkyl phthalate are added to the dispersion and the pH of the mixture is adjusted to 7.0 with 7 parts of a 10% strength sodium hydroxide solution. This produced a just perceptible thickening of the dispersion.

The concentration of the dispersion is 15.1% and the average diameter of the capsules is from 8 to 11 $\mu$. The viscosity of the dispersion is 26.5 seconds in a DIN cup (4 mm orifice).

D. Testing the capsule dispersion

For testing, the capsule dispersion is applied to a paper weighing 36 g/m², using an 18 G2z wire doctor blade. The product is dried for 24 hours at room temperature. The capsule coating weighs 5 g/m² and is gray-black. Its depth of color is somewhat less than that of conventional carbon papers. The hand of the coated surface resembles that of a conventional paper surface and the material does not mark the fingers even when these are passed repeatedly over the surface. The product does not give the impression of a smeary or waxy surface, as is given by the conventional copying papers containing carbon.

Some of the paper is stored at room temperature, some at 80°C and some at 95°C, for 15 hours. After storage, the coated papers are placed with the coated face downward on a sheet of normal typewriting paper, but into an electric typewriter and typed on, using touch setting 2. The resulting copy is rated as follows:

1 intense coloration, very sharp script, very easily legible.
2 strong coloration, easily legible.
3 high-contrast coloration, completely legible.
4 pale coloration, just legible.
5 no coloration, no copy.

The copy produced in the present example gives a rating of 2 when the paper coating is stored at room temperature, a rating of 2 to 3 after storage at 80°C and again a rating of 2 to 3 after storage at 95°C. The copy is in a neutral black and gives an attractive script appearance which does not change in intensity and shade after 5 months' storage. The coating has a good shelf life, as is shown by a hot storage test.

E. Comparison with one-time carbon paper

For comparison with conventional one-time carbon paper, the reflection values of the back of the paper which produces the copy, and the resulting reflection values of the copy, were determined with an Elrepho instrument (photoelectric reflectance photometer from Carl Zeiss, Oberkochen, Federal Republic of Germany), using a green filter (color measuring filter Y with standard light C, identical to the CIE system or DIN Standard Specification 5033). The results, in % of reflected light, are shown in the table.

| | Example | One-time carbon paper |
|---|---|---|
| Back | 33% | 3% |
| 1st copy | 56% | 51% |
| 5th copy | 51% | 47% |
| (white paper used for copying | 87% | 87% |
| Coating, g/m² | 4.5 g | 6.0 g |
| Rub resistance of the copy | no smudging | smudges extensively |

The capsule coating, which gives 33% reflected light (white paper giving 87%), merely has a gray appearance, whilst the one-time carbon paper coating only reflects 3% and is deep black. Though it has a lower coating weight, the capsule coating gives only a slightly less intense copy than the one-time carbon paper, the figures being 56% as against 51%, but the former copy cannot be smudged and its script, after rubbing, remains black and easily legible, and contrasts with the background. In contrast, the legibility of the one-time carbon paper copy is easily affected by smudging. As a result of smudging, the reflection of the background decreases and that of the script increases; hence the contrast decreases. This leaves out of account the fact that the low rub resistance also causes soiling of the paper outside the script. The decrease in reflectance is the same for both papers, as can be seen from the table by examining the figures for the reflection of the fifth copy (five copy papers placed behind one another). The lower reflection results from the fact that with an increasing number of copies the pressure of the typewriter key acts on a larger area. This produces a more blurred script appearance.

The intensity of the copy can be increased by increasing the weight of capsule coating applied.

EXAMPLE 2

A. A dye salt solution is prepared, following the procedure in Example 1, by first dissolving 250 parts of nigrosine base C with 200 parts of oleic acid and then adding 550 parts of spindle oil. The viscosity of the solution at room temperature is 266 cP. The solution contains 25% of nigrosine base C.

B. The dye salt solution is encapsulated with the same wall material, and in the same manner, as in Example 1, and the capsules are cured and stabilized. A 16.4% strength capsule dispersion, containing capsules of average diameter 10 to 15 μ and having a viscosity of 30 seconds in a DIN cup (4 mm orifice) is obtained.

C. The capsule dispersion is tested as in Example 1. The copy produced by the paper after storage at room temperature is rated 3, and after storage at 80° and 90°C the rating is unchanged and is also 3. The shade of the copy is violet-tinged black. The shade and intensity are unchanged after 9 months.

EXAMPLE 3

A. 200 parts of nigrosine base C are dissolved in 200 parts of oleic acid and diluted with 600 parts of gasoline (boiling point from 155° to 180°C). The viscosity of the solution is 89 cP.

B. Following the procedure of Example 1, the dye salt solution is encapsuled, the capsule wall is cured and the dispersion is stabilized. A 15.8% strength dispersion containing capsules of average diameter from 10 to 17 μ is produced. The viscosity of the dispersion is 16 seconds, measured in the DIN cup, at room temperature.

C. The capsule dispersion is tested after coating a paper, as in Example 1. The copy produced with paper stored at room temperature is rated 2 to 3 and that with paper stored at 80° and 95°C is rated 3. The shade of the copy is violet-tinged black. The shade and intensity are unchanged after 9 months' storage.

EXAMPLE 4

A. 110 parts of rhodamine base B extra are dissolved in 88 parts of oleic acid and 132 parts of spindle oil and 170 parts of diethylhexyl phthalate are then added. a suspension containing 22% of dye base and having a viscosity of 220 cP is obtained.

B. The encapsulation is carried out as in Example 1, except that only 12 parts of isopropanol are added, an additional 60 parts of chloroform are used, and 240 parts of a 40% strength wall material solution, containing a copolymer of 150 parts of acrylamide, 420 parts of butanediol monoacrylate acetylacetate, 420 parts of methyl methacrylate and 0.5 part of acrylic acid are employed. A 13.2% strength dispersion containing capsules of average diameter from 6 to 9 μ is obtained.

C. The capsule dispersion is tested as in Example 1, after coating on paper. The copy produced with paper stored at room temperature is rated 2 whilst the intensity of the copies obtained with papers stored at 80°C and 95°C is rated 3. The copy has a deep red-purple color.

EXAMPLE 5

A. The dye salt solution is prepared as in Example 1. The viscosity of the solution is 900 cP.

B. 44 parts of the nigrosine base solution mentioned under 1 (A), 24 parts of isopropanol and 23 parts of phthalic acid diethylhexyl ester are introduced into a beaker of capacity 800 parts by volume, and are heated to 55°C. During this period, the contents of the beaker are stirred by a high speed stirrer fitted with a stirring disc of 52 cm diameter with saw-like teeth around the edge, and rotating at about 5,500 rpm. A solution of 10 parts of hogskin gelatine in 80 parts of water, which has been heated to 55°C and adjusted to a pH of 5.5 with acetic acid, is added. A solution of 10 parts of gum arabic in 80 parts of water, which has been heated to 55°C, is then poured in in the course of 6 minutes. A dispersion with particles of diameters from 1 to 40 μ, the average diameter being from 3 to 5 μ is obtained.

240 parts of this emulsion are weighed into a beaker of capacity 1,000 parts by volume, kept at 55°C and stirred at 2,100 rpm with the high-speed stirrer fitted with a cage-type stirrer. The pH is adjusted to 5.5 with 1N NaOH, 300 parts of water at 55°C are then added dropwise in the course of 10 minutes and the pH of the mixture is adjusted to 4.5 with 0.1N acetic in the course of about 10 minutes. The mixture is then stirred for a further 20 minutes at the same temperature. At this stage, the emulsion contains particles of average diameter 7 to 12 μ 2.8 parts of 40% strength aqueous formaldehyde solution are added in the course of 50 minutes and the whole is then cooled as rapidly as possible to 5°C in an ice-water bath, whilst being stirred. To effect the curing, the pH of the dispersion is then slowly raised to 9.5 with 1N NaOH. After stirring for 12 hours at 5° to 10°C, a capsule dispersion containing capsules of average diameter from 2 to 12 μ is obtained. In addition, loose agglomerates are present. The capsule dispersion is sieved through a 60 μ mesh sieve, with vigorous shaking. The resulting capsule dispersion is tested.

C. Paper is coated with the capsule dispersion using a wire doctor blade (18 μ) as in Example 1, the paper is dried and then stored for 16 hours at room temperature or 80° or 95°C, and a copy is then produced. The intensity of the copy is rated 3 at room temperature, 3 to 4 after storage at 80°C and 3 to 4 after storage at 95°C. The contours are sharp and the script is legible.

EXAMPLE 6

A. Following the procedure of Example 1, 500 parts of nigrosine base LT are dissolved in 300 parts of oleic acid. The reaction mixture, whilst still warm, is then diluted to 20% dye content with 870 parts of spindle oil and 830 parts of n-dodecylbenzene. This dye salt solution solidifies to a gel when cooled to room temperature (23°C). On measuring the viscosity with a Haake viscometer, different results are obtained at different shear rates:

| | | | | |
|---|---|---|---|---|
| Shear rate in $sec^{-1}$ | 2.7 | 24.5 | 147 | 441 |
| Viscosity in cP | 17,400 | 3,360 | 1,090 | 630 |

B. The dye salt solution is encapsulated as in Example 1. A 16% strength capsule dispersion with capsules of average diameter from 10 to 15 $\mu$ is obtained. The viscosity of the dispersion is 22.7 seconds in a DIN cup.

C. 500 parts of this capsule dispersion, 40 parts of cellulose powder and 60 parts of a 50 percent strength by weight styrene/acrylic ester copolymer dispersion in water are mixed and coated onto paper using a wire doctor blade. After drying, the coating weight is 9.5 $g/m^2$. Samples of the paper obtained are respectively stored for 16 hours at room temperature, at 80°C and at 90°C. The intensity of a copy is then determined. It is rated 3 in all cases, regardless of storage. This shows that solutions with a pronounced structural viscosity give good dye transfer provided the viscosity is low at fairly high shear rates (say above 100 $sec^{-1}$).

EXAMPLE 7

A. Instead of using oleic acid, the dye base is dissolved with rosin, using the procedure of Example 1. For this, 500 parts of nigrosine base LT are dissolved with 360 parts of rosin at 140°C and the mixture is diluted with 1,640 parts of diethylhexyl phthalate to give a solution containing 20% of dye. The viscosity of the solution is 3,100 cP at 25°C.

B. The encapsulation is carried out in accordance with Example 1. A 15.8% strength dispersion with particles of average diameter from 12 to 15 $\mu$ is obtained.

C. Paper is coated with 5.4 g of capsules/$m^2$ of paper, and after storage at room temperature the intensity of a copy is rated 3, after storage for 16 hours at 80°C it is also rated 3 and after 16 hours at 95°C the intensity is rated 3 to 4.

We claim:

1. A non-smudging pressure-sensitive copying material which comprises: a sheet-like base and a coating on said base, said coating including microcapsules, said microcapsules containing as a core material a solution of a salt of a dye base and an aliphatic carboxylic acid of eight to thirty carbon atoms in an organic water-immiscible solvent, the ratio of organic carboxylic acid to dye base is from about 1:1 to equivalents.

2. A copying material as claimed in claim 1, wherein the dye base is a nigrosine base or an induline base.

3. A copying material as claimed in claim 1, wherein the organic water-immiscible solvent consists of high-boiling aliphatic or araliphatic hydrocarbons or phthalic acid esters of aliphatic alcohols of three to 18 carbon atoms, or mixtures thereof.

4. A copying material as claimed in claim 1, wherein the concentration of the dye base in the organic water-immiscible solvent is from 5 to 50 percent by weight.

5. A copying material as claimed in claim 1, wherein the viscosity of the solution or suspension of the dye salt in the organic water-immiscible solvent is 10 to 10,000 cP at a rate of shear of 100 $sec^{-1}$.

6. A copying material as claimed in claim 1, wherein the wall material of the microcapsules is gelatine or an acrylic ester copolymer.

7. A copying material as claimed in claim 1, wherein the microcapsules contain a pigment additionally to the dye salt solution.

8. A copying material as claimed in claim 1, wherein the sheet-like base is paper.

9. A copying material as claimed in claim 1, wherein the binder for the microcapsule coating is a polymer dispersion based on vinyl acetate, styrene/butadiene, styrene/acrylate or acrylate copolymers.

10. A copying material as claimed in claim 1, wherein the micro-capsule coating contains cellulose or polystyrene as a filler.

11. A copying material as claimed in claim 1, wherein the micro-capsule layer bears a coating which masks the inherent color of the microcapsules.

* * * * *

UNITED STATES PATENT AND TRADEMARK OFFICE

CERTIFICATE OF CORRECTION

PATENT NO. : 3,934,069

DATED : January 20, 1976

INVENTOR(S) : Otto Atzrott et al.

It is certified that error appears in the above-identified patent and that said Letters Patent are hereby corrected as shown below:

In Column 4, Line 45, delete " 4 to 5 $g/m^2$ " and substitute -- 4 to 6 $g/m^2$ --

In Column 6, Line 10, delete " using an 18G2z wire " and substitute -- using an 18$\mu$ wire --

In Column 10, Claim 1, Line 11, delete " about 1:1 to equivalents. " and substitute -- about 1:1 to 2:1 equivalents. --

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*